US007387361B1

(12) United States Patent
Rueby et al.

(10) Patent No.: US 7,387,361 B1
(45) Date of Patent: Jun. 17, 2008

(54) FAILED NOZZLE CORRECTION SYSTEM AND METHOD FOR BORDERLESS PRINTING

(75) Inventors: Christopher Rueby, North Chili, NY (US); Douglas W. Couwenhoven, Fairport, NY (US); Steven A. Billow, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/675,761

(22) Filed: Feb. 16, 2007

(51) Int. Cl.
*B41J 2/15* (2006.01)

(52) U.S. Cl. ..... 347/41; 347/15; 358/1.9

(58) Field of Classification Search ..... 347/15, 347/19, 43, 1.2, 1.9, 41, 16, 105; 358/1.2, 358/1.9
See application file for complete search history.

(56) References Cited

U.S. PATENT DOCUMENTS

| | | | | |
|---|---|---|---|---|
| 5,124,720 | A | 6/1992 | Schantz | |
| 5,555,006 | A | 9/1996 | Cleveland et al. | |
| 6,179,407 | B1 | 1/2001 | Bockman | |
| 6,283,572 | B1 * | 9/2001 | Kumar et al. | 347/19 |
| 6,310,640 | B1 | 10/2001 | Askeland | |
| 6,364,451 | B1 | 4/2002 | Silverbrook | |
| 6,375,307 | B1 | 4/2002 | Vinals et al. | |
| 6,441,922 | B1 * | 8/2002 | Askeland et al. | 358/1.9 |
| 6,447,091 | B1 | 9/2002 | Calvo et al. | |
| 6,454,378 | B1 | 9/2002 | Silverbrook et al. | |
| 6,454,389 | B1 | 9/2002 | Couwenhoven et al. | |
| 6,530,645 | B2 | 3/2003 | Haflinger | |
| 6,930,696 | B2 | 8/2005 | Otsuki | |

* cited by examiner

*Primary Examiner*—Lamson D. Nguyen
(74) *Attorney, Agent, or Firm*—Donna P. Suchy

(57) ABSTRACT

A method for compensating for failed nozzles in multi-pass printing using an inkjet printer having at least one printhead containing a plurality of nozzles to print an input image having a plurality of raster lines on a receiver media.

16 Claims, 9 Drawing Sheets

A
B
10
11A
18A
12
16
13
19A
11B
18
19B
18B

EXAMPLE: 7 PASS MODE, 3 PRELOAD PASSES

PASS NUMBER: 1 2 3 4 5 6 7 8 9 10 11 12

FAILED NOZZLE CORRECTION SYSTEM AND METHOD FOR BORDERLESS PRINTING

FIELD OF THE INVENTION

The invention relates generally to the field of swath-type printing, such as inkjet printing, and more particularly to a method for altering a print mask and controller to compensate for failed inkjet nozzles as the printhead approaches and passes through a paper position such as a transition position thus solving the problem of failed nozzle correction for borderless printing.

BACKGROUND OF THE INVENTION

Inkjet printing is a non-impact method for producing images by the deposition of ink droplets in a pixel-by-pixel manner onto an image-recording element in response to digital signals. There are various methods that may be utilized to control the deposition of ink droplets on the receiver member to yield the desired image. In one process, known as drop-on-demand inkjet printing, individual droplets are ejected as needed onto the recording medium to form the desired image. Common methods of controlling the ejection of ink droplets in drop-on-demand printing include piezoelectric transducers and thermal bubble formation using heated actuators. With regard to heated actuators, a heater placed at a convenient location within the nozzle or at the nozzle opening heatsink in the nozzle to form a vapor bubble that causes a drop to be ejected to the recording medium in accordance with image data. With respect to piezoelectric actuators, piezoelectric material is used in conjunction with each nozzle and this material possesses the property such that an electrical field when applied thereto induces mechanical stresses therein causing a drop to be selectively ejected from the nozzle selected for actuation. The image data provides signals to the printhead determining which of the nozzles are to be selected for ejecting an ink drop, such that each nozzle ejects an ink drop at a specific pixel location on a receiver sheet.

In another process, known as continuous inkjet printing, a continuous stream of droplets is discharged from each nozzle and deflected in an image-wise controlled manner onto respective pixel locations on the surface of the recording member, while some droplets are selectively caught and prevented from reaching the recording member. Inkjet printers have found broad applications across markets ranging from the desktop document and pictorial imaging to short run printing and industrial labeling.

A typical inkjet printer produces an image by ejecting small drops of ink from the printhead containing a spatial array of nozzles, and the ink drops land on a receiver medium (typically paper, coated paper, etc. and referred to generically here as paper or page or media) at selected pixel locations to form round ink dots. Normally, the drops are deposited with their respective dot centers determined by a rectilinear grid, i.e. a raster, with equal spacing in the horizontal and vertical directions. The inkjet printers may have the capability to either produce dots of the same size or of variable size. Inkjet printers with the latter capability are referred to as multitone or gray scale inkjet printers because they can produce multiple density tones at each selected pixel location on the page.

Inkjet printers may also be distinguished as being either pagewidth printers or swath printers. Examples of pagewidth printers are described in U.S. Pat. Nos. 6,364,451 B1 and 6,454,378 B1. As noted in these patents, the term "pagewidth printhead" refers to a printhead having a printing zone that prints one line at a time on a page, the line being parallel either to a longer edge or a shorter edge of the page. The line is printed as a whole as the page moves past the printhead and the printhead is typically stationary, i.e. it does not transverse the page. These printheads are characterized by having a very large number of nozzles. The referenced U.S. patents disclose that should any of the nozzles of one printhead be defective the printer may include a second printhead that is provided so that selected nozzles of the second printhead substitute for defective nozzles of the primary printhead.

A swath printer uses a printhead having a plurality of nozzles disposed in an array in one or more rows, such that the length of the array is somewhat less than the height of the page. The multiple rows can be nozzles for ejecting different ink colors or different droplet sizes. Multiple rows are also used to increase the effective nozzle resolution for printing by staggering the rows of nozzles along the length of the array. Because the array length is less than the height of a page, printing is done in swaths (sometimes referred to as "passes" or "print passes") having a height, which is equal to or less than the array length. A swath is printed as the printhead traverses across a page to be printed in a traversal direction, which is substantially perpendicular to the array length. The printhead traversal direction is also referred to as the fast scan direction. After the swath is completed, the paper is advanced along a paper movement axis, which is perpendicular to the printhead traversal direction. The paper movement axis is also called the slow scan direction. The distance of paper advance is set to be less than or equal to the swath height in order to allow every pixel location on the page to be printed in successive swaths. For fastest printing throughput, all pixels to be printed in the region traversed by the printhead are printed during a single pass, and the page advance is set to the swath height. However, in many applications it is found that print quality is improved if a subset of pixels is printed in each pass, and multiple passes are used to print each region. In multi-pass printing, the page advance distance is set to be less than the swath height.

There are many techniques present in the prior art that describe methods of controlling the printer including "print masking." The term "print masking" generally refers to printing subsets of the image pixels in multiple passes of the printhead relative to a receiver medium. The print mask indicates which pixels have permission to be printed during a given pass of the printhead. See for example U.S. Pat. No. 6,454,389.

When printing on a cut-sheet inkjet printer, the paper is held by (at least) two sets of rollers. The first set is made up of a long main roller below the paper and one or more rollers above. The upper rollers are tensioned against the lower roller and are free turning. The lower roller is driven to advance the paper. The second set of rollers has a long main roller below the paper and one or more star wheels above the paper. The star wheels are tensioned against the lower roller and are free turning. The second upper set are star shaped to minimize contact with the freshly printed paper surface and to avoid smearing the ink.

As the paper is fed through the printer, it starts out held by only the first roller set. In this portion of the printing process, the paper may curl up or down, changing the head/paper spacing which changes dot alignment. Part way into the print, the paper will start being held by the star wheel rollers also. This middle area of the print is the most stable for paper advance and head/paper spacing since the paper is held by both sets of rollers. Then, at the end of the print, the paper comes out of the first roller and is only held by the star wheel rollers. At this point, paper curl could change the head/paper spacing. Also, the paper advance distances may not be as accurate when the paper is only held by the star wheel rollers. Thus, the area near the edges or borders are not effectively printed. Techniques are known in the art to provide for improved quality in borderless printing regions (near the beginning and/or end of the page) where the paper is not held by both sets of rollers. See for example U.S. Pat. No. 6,930,696. It is also known in inkjet printing that individual nozzles can fail to eject drops when commanded, due to a variety of reasons including electrical failure, clogging with fibers or contaminants in the ink, drying out, and others. When a nozzle fails, an unprinted streak appears in the image, causing an undesirable image artifact. Multipass printing in which the page is advanced by less than the swath height provides a means for allowing more than one nozzle to print a given line, thereby minimizing the appearance of the failed nozzle since not all dots in the given line will be missing. Additionally, it is known in the art to redirect the printing duty of the failed nozzle to another nozzle that prints along the same line, so that the unprinted locations are minimized or eliminated, thereby "correcting" for the failed nozzle. See for example U.S. Pat. No. 5,124,720. However the prior art techniques for failed nozzle correction do not sufficiently address the problem of providing for failed nozzle correction in the borderless regions of the print, where the paper is not engaged by both sets of rollers.

SUMMARY OF THE INVENTION

It is an object of the present invention to provide for improved print quality in borderless printing with an inkjet printer. Another object of the present invention is to provide for improved print quality in borderless inkjet printing when one or more nozzles in the inkjet printhead have failed or are otherwise malperforming. These objects are achieved by compensating for failed nozzles in multi-pass printing using an inkjet printer having at least one printhead containing a plurality of nozzles to print an input image having a plurality of raster lines on a receiver media using a plurality of passes. The method determines plurality of image regions, each image region corresponding to at least one raster line of the input image and then computes a nozzle group list for each image region, wherein each nozzle group list describes a set of nozzles used to print each raster line of the image region during each pass. The nozzle group list is used remap the printing of ink drops from the failed nozzle to at least one other nozzle.

While the specification concludes with claims particularly pointing out and distinctly claiming the subject matter of the present invention, it is believed the invention will be better understood from the following detailed description when taken in conjunction with the accompanying drawings.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art. In the specification, various terms are employed and are defined as discussed above and summarized below as follows.

The term "print mask" is related to the controls that are used to give permission to print, referring to the dot forming elements, including nozzles, and including an image-independent matrix determining which printing element (nozzle) should be used for each potential dot location on a receiver. A print mask can be used for multi-pass, multi-drop and multi-channel (which includes color or other printable materials) situations.

The term "dot forming elements" refers to any of the myriad of ways, including the nozzles of an inkjet printer, that a dot may be formed on a recording medium.

The term "print mode" refers to the set of instructions relative to one mask matrix (width×height), the number of passes, and the maximum number of drops per pixel. If any of these parameters change then it is a mode change.

Figure 3:
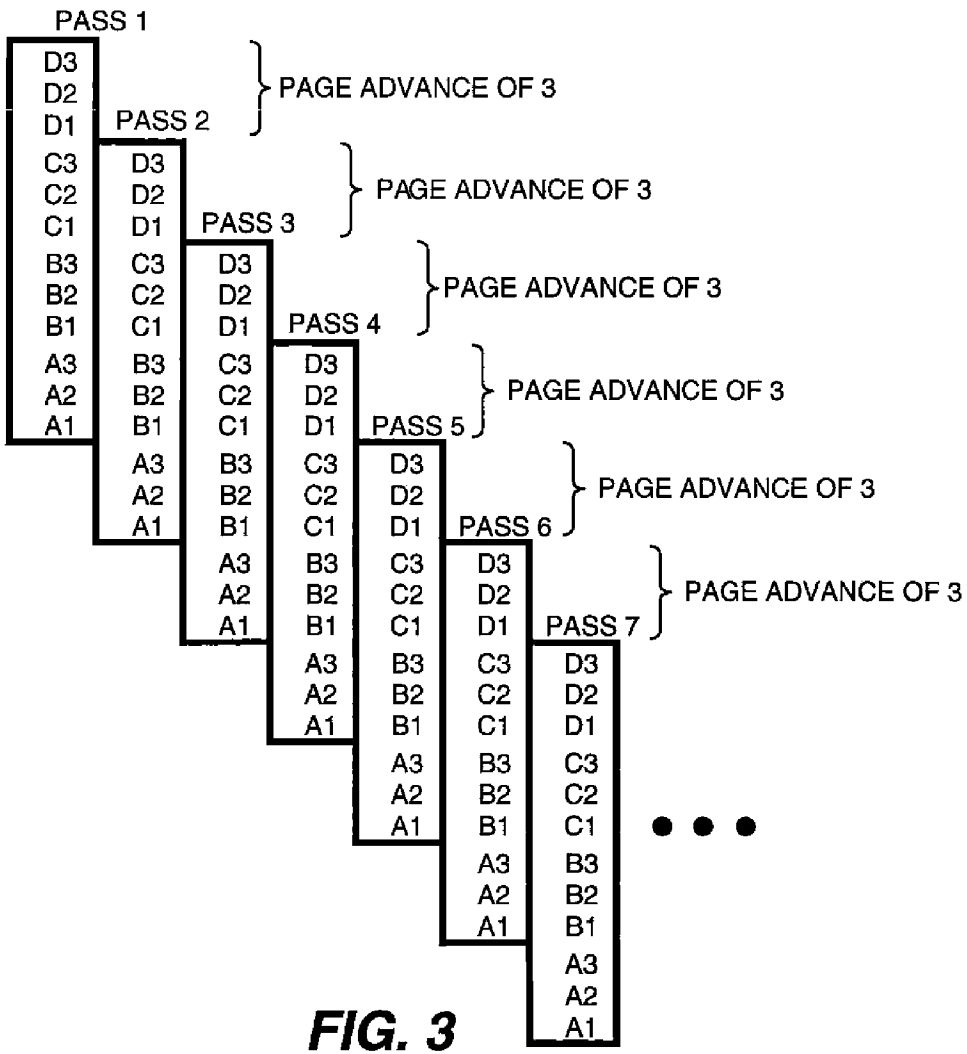
FIG. 3 illustrates an exemplary mask for normal multipass printing.

For one of the contiguous sections of nozzles that compose the mask (see the following descriptions and associated drawings), the height of the mask section is determined by taking the total mask height (in number of nozzles) and dividing by total number of passes for that particular mode $\therefore$ section height size=mask height/# passes The term "complementary nozzles" refers to a set of nozzles, one from each mask section, each of which will have the capability of printing pixels on the same raster line of the output print as the media is advanced for each successive print swath. Complementary nozzles line up with each other on any given raster line of the printed output as is illustrated in FIG. 3 where there are three sets of complementary nozzles:

Set 1: Mask positions A1, B1, C1, D1 [those for the first line to be printed]

Set 2: Mask positions A2, B2, C2, D2 [those for the second line to be printed]

Set 3: Mask positions A3, B3, C3, D3 [those for the third line to be printed]

The term "printhead size" refers to the number of nozzles contained in the printhead. This term usually refers to the number of nozzles capable of printing one color and is generally configured in a linear or rectangular formation such as that necessary to define 1-2 columns of nozzles.

FIG. 1, shows a printer 10 having an inkjet printhead 12 with dot forming elements that include devices such as nozzles (not shown) mounted on a carriage 16 facing the recording medium, also referred to generically as a page, paper, media, or receiver 18. Carriage 16 is coupled through a timing belt and a driver motor (not shown) so as to be reproducibly movable back and forth in a direction perpendicular to the movement (shown by arrow A-B) of the recording medium 18. It will be understood that for a printer having multiple different color inks that there may be multiple printheads similar to that described for printhead 12. The different color printheads are arranged on a carriage 16 that traverses across the receiver sheet for a print pass. The nozzles in each of the color printheads, are actuated to print with ink in their respective colors in accordance with image instructions received from a controller or image processor using the various print masks described below.

Figures 1A, 1B, 1C:
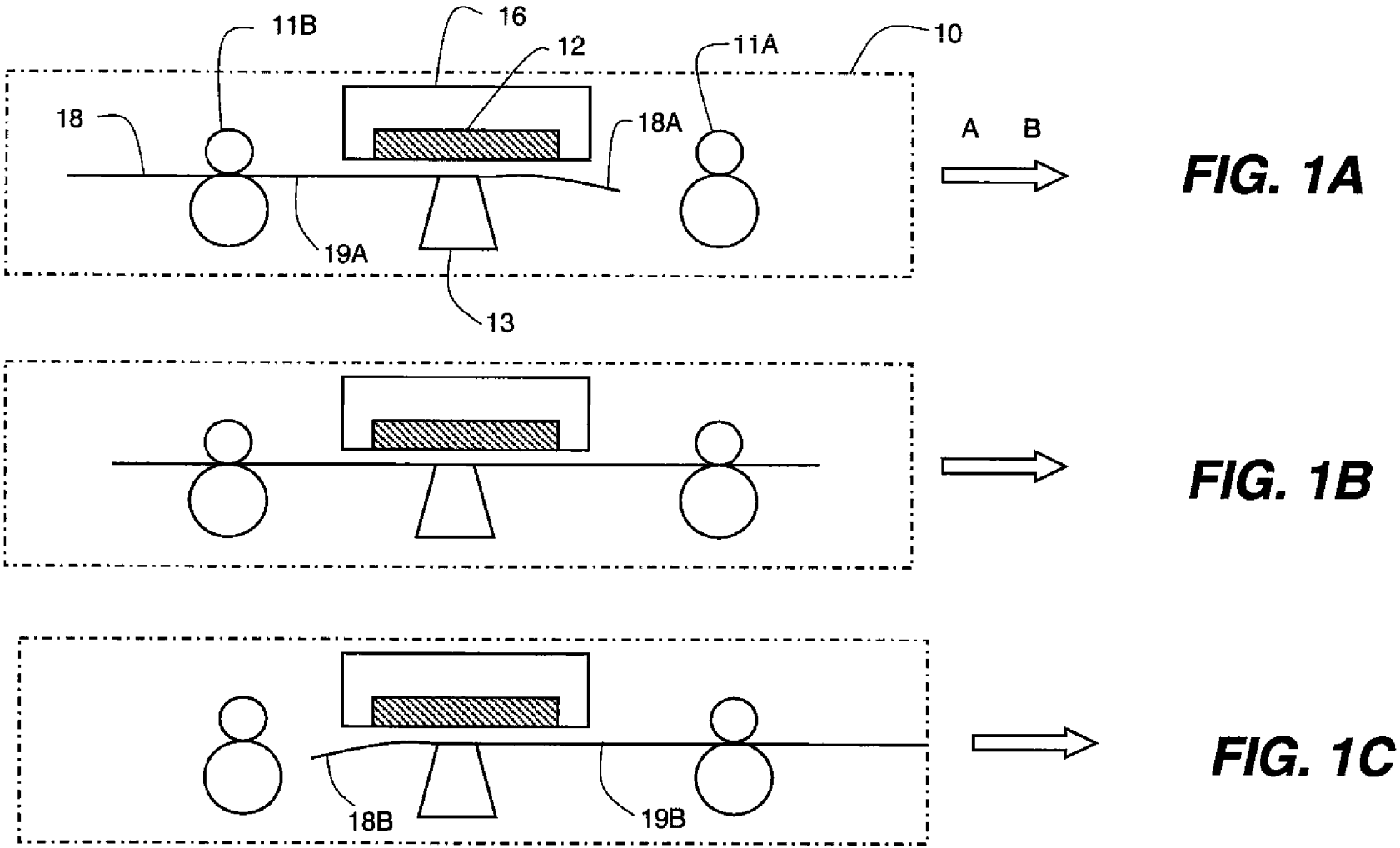
FIG. 1A shows a printer with the leading end of the paper held by one set of rollers.
FIG. 1B shows a printer with the paper being held by both sets of rollers.
FIG. 1C shows a printer with the trailing end of the paper held by one set of rollers.

As the paper moves through the printer, it moves through different regions, as shown in FIGS. 1A, 1B and 1C. In FIG. 1A, a leading portion of the paper 18 is held by roller set 11*b*, but the leading edge 18*a* has not yet reached roller set 11*a*. Another leading portion of the paper 18 is supported by rib structure 13. However, the leading edge 18*a* which has passed rib structure 13 but has not yet arrived at roller set 11*a*, may deviate somewhat in its straightness. As a result, both the paper advance accuracy and the printhead 16 to paper 18 distance in this region may not be well controlled. By comparison, in FIG. 1B, the paper 18 is held by both roller sets 11*a* and 11*b*, so that paper motion and printhead to paper distance are well controlled. There is a transition region located approximately at point 19*a* in FIG. 1A, such that when point 19*a* is located under printhead 12. the paper begins to be held by both sets of rollers. Correspondingly, FIG. 1C shows another transition region near the trailing end 18*b* of the paper, such that when point 19*b* passes from beneath printhead 12, the paper 18 is no longer being held by roller set 11*b*, so that again the paper advance accuracy and the printhead to paper distance are not well controlled, as in FIG. C. In general, one or more transition positions 19 may be defined, for example, between the leading edge and the middle region, and also between the middle region and the trailing edge.

Figure 2:
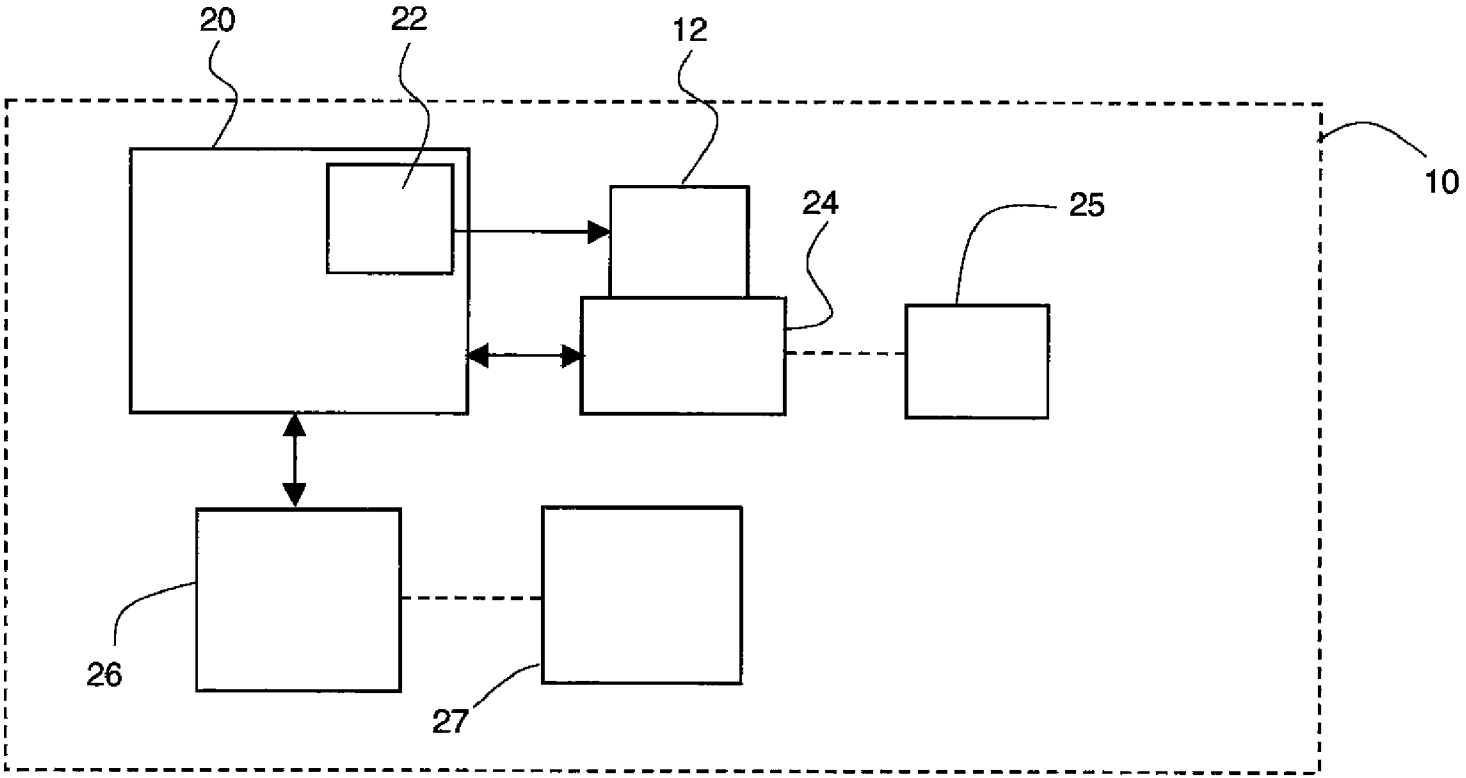
FIG. 2 shows a schematic illustrating the control features on an inkjet printer.

FIG. 2 shows a schematic of a printer control features including a print mask to control nozzle operations. The inkjet printer 10 has a controller 20 including a print mask 22 to determine which nozzles of printhead 12 should be used to print each potential dot location on the receiver medium. Also shown are carriage motion controller and driver 24, carriage motor 25, media advance controller and driver 26, and media advance motor 27. The controller 20, which may include one or more micro-computers is suitably programmed to provide signals to the carriage motion controller and driver 24 that directs the printhead carriage drive to move the printhead. While the printhead is moving, the controller uses the print mask 22 to direct the printhead to eject ink drops onto the receiver medium 18 at appropriate pixel locations of a raster line. Pixels on the raster line are selectively printed in accordance with image signals representing print or no print decisions for each pixel location and/or pixel density gradient or drop size for each pixel location. The controller 20 may include a raster image processor, which controls image manipulation of an image file, which may be delivered to the printer via a remotely located computer through a communication port. Memory in the printer may be used to store the image file while the printer is in operation. Thus as noted above the printer may include a number of printheads or nozzle arrays, each for a different color. Preferably the printer includes enough printheads or nozzle arrays to print three or more different color inks.

The bitwise print mask 22 contains a row of boolean data per nozzle in the printhead 12. The height H of the mask is less than or equal to the number of nozzles in the printhead. The value in each position of the mask is logically ANDed with the image data to determine whether to eject a drop at each location. Each mask row may contain 1 or more columns C. If the mask is narrower than the width of the image being printed, the mask is tiled across the image. The mask is divided into N sections, where N is the number of print passes to be performed on the image, and N is at least 1. The height of each section SH is the same, calculated as SH=H/N. The value of H must be picked such that SH is a whole integer number. The value SH is also the number of lines that the page is advanced after each carriage pass or swath. The corresponding nozzles from each mask section that are capable of printing on the same output raster line are known as complementary nozzles. The complementary nozzles are the ones that print a single row of the image as the page is advanced.

Below is a diagram showing the structure of a simple 4-pass print mask. In this example H=12, N=4, SH=3, and C=1. In this and subsequent examples, unless otherwise stated, the printhead is assumed to have 12 nozzles. For typical printers, the actual number of nozzles is usually several hundred or more, and the mask height H will also be correspondingly much greater than 12. Dotted lines in the diagram represent the boundaries between mask sections.

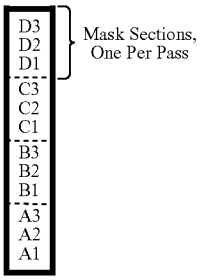

A section letter and a number (i.e. the mask layout identifiers) denote the positions in the mask. The data values at each position can be either a 0 or 1. In this example, there are three sets of complementary nozzles:

Set 1: Mask positions A1, B1, C1, D1

Set 2: Mask positions A2, B2, C2, D2

Set 3: Mask positions A3, B3, C3, D3

Here the complementary nozzles are the ones that will fall on the same line of the output print when the media is advanced for each successive swath. The print mask is mapped onto the printhead as shown below. Note that the printhead may have more nozzles than the print mask has entries.

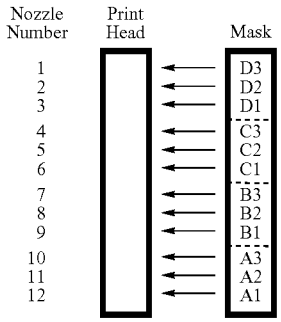

For example, the following is a 4-pass print mask that can lay down 1 drop per pixel:

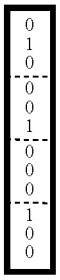

It would map onto the print head as follows:

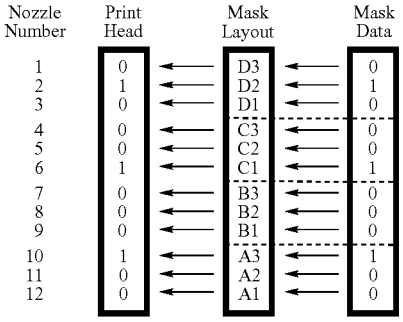

As shown in FIG. 3, the printhead 12 is advanced relative to the page 18 at the end of each swath. Actually it is the paper that is being moved, but for simplicity of representation, the figures are drawn as if the printhead is moving in the opposite direction than the paper is actually being moved. This example shows a 4-pass 12-nozzle mask. The mask layout identifiers are shown in the printhead. Note in the figure that the mask is shown as moving with the printhead. In other words, in FIG. 3, mask position A1 is always associated with nozzle 12, A2 is always associated with nozzle 11, etc. This is the case for normal multi-pass printing. This diagram shows how the printhead moves in relation to the page from swath to swath for purposes of illustration, but does not imply that the printhead is moving in that direction. In this figure it can be seen how the complementary nozzles line up with each other on any given line of the output.

Figure 4:
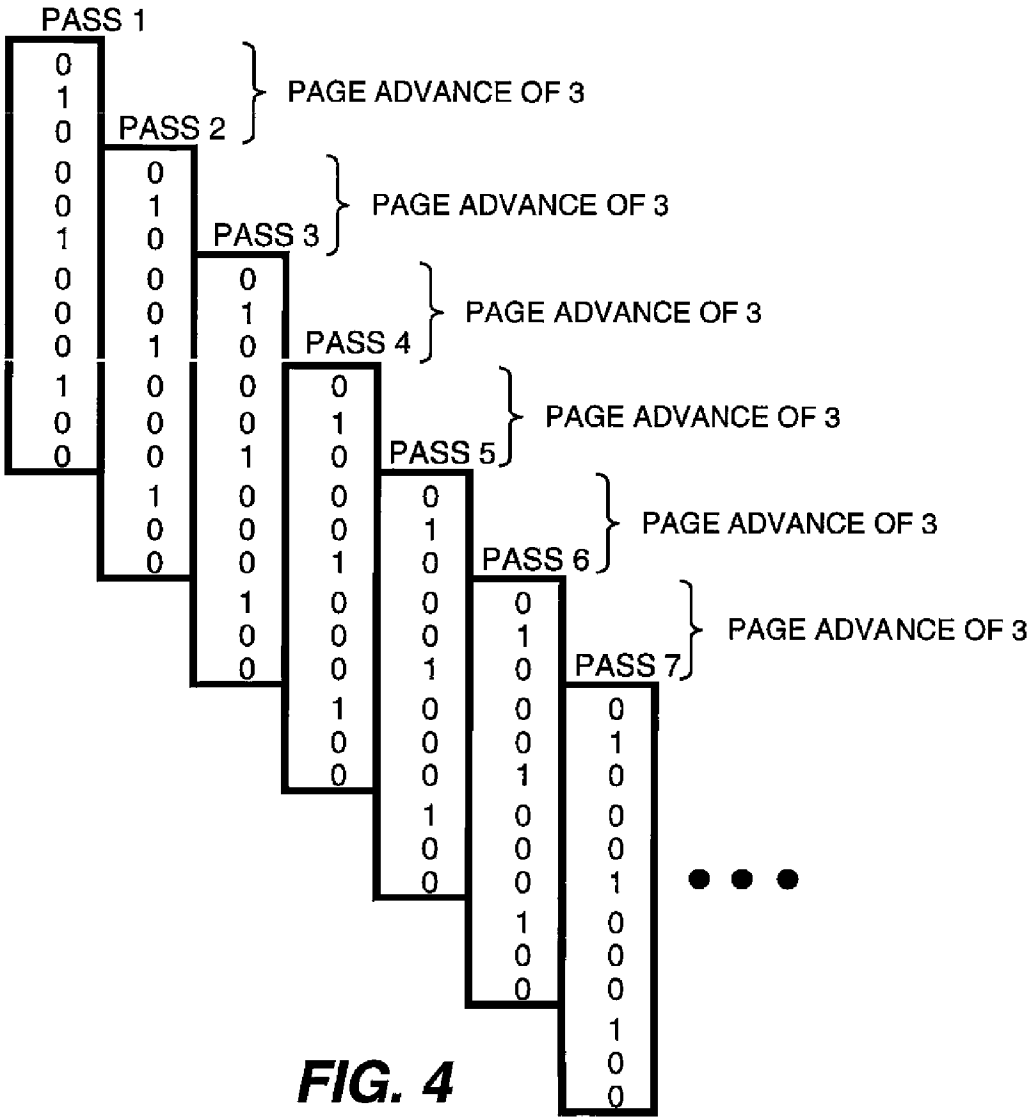
FIG. 4 illustrates the mask of FIG. 3 with the mask data shown in the corresponding printhead nozzle locations.

The mask is tiled across the width of the image. For example, if a print mask had a width of 4, the first column of the image data would be applied against the first column of the print mask. The second column of the image data would be applied against the second column of the print mask, and so on. The fifth column of the image would be applied against the first column of the print mask, as the mask is tiled. FIG. 4, discussed below, shows the same mask as in FIG. 3, but with the mask data shown in the printhead, rather than the mask layout identifiers.

FIG. 4 shows that on any one line of the image, there is only one pass that may lay down a drop in a particular pixel location. Note that this mask is a 4-pass mask that will print at most one drop per pixel.

In order to handle printing of multiple drops per pixel location, the mask may contain more than one plane. The number of drops that is desired to be printed at each location is used to determine which plane of the mask to use for that location. The first plane of the mask is used to print at locations where there will be one drop. The second plane of the mask is used to print at locations where there will be two drops, and so on up to the number of planes in the mask. When the input image data is zero, no drop ejection is called for, and there is nothing to look up in the print mask. A mask may contain up to N planes, where N is the number of print passes to be performed on the image, and N is at least 1. Plane P of the mask, where 1<=P<=N, has complementary nozzle data that adds up to the value P.

The following diagram shows the contents of a print mask following the above rules. In this example H=12, N=4, SH=3, C=1, P=4. Thus, there are 4 planes of data in the print mask. Adding the complementary nozzle mask values of each plane together results in a value equal to the plane number (i.e. number of drops).

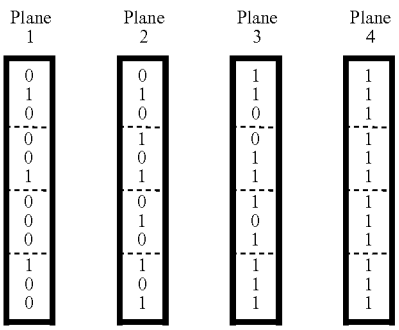

The use of this type of multi-plane print mask follows the same sequence of printing as does the previous examples, with one change: The value of the input pixel at each location will determine which plane of the print mask is used for determining whether to output a drop at that location. The use of a multi-planed print mask is described more fully in U.S. patent application Ser. No. 11/362,346 entitled "MULTI-LEVEL PRINTING MASKING METHOD", filed on Feb. 24, 2006 by Eastman Kodak, in the names of Steven A. Billow, Douglas W. Couwenhoven, Richard C. Reem, and Kevin E. Spaulding, the contents of which are fully incorporated by reference as if set forth herein.

Continuing with the description of the present invention, a few more terms and concepts will now be introduced. A "preloaded" pass is now defined wherein the print mask is shifted by a number of nozzle positions relative to the printhead. Preloaded passes are used in situations where multipass printing is desired, but it is advantageous to keep the page stationary. Examples of this situation commonly occur at the top and bottom of a "borderless" print, in which it is desired that ink is deposited right up to the edge of the page, with no unprinted border surrounding the printed area. It is known in the art that in borderless print modes, it is advantageous to keep the media stationary at a position in the printer where the flatness of the paper surface can be maintained, thereby providing improved print quality. For example, U.S. Pat. No. 5,555,006 discusses "sweep rotation" of the mask near the top and bottom of the page (see section 6 of '006). Sweep rotation of a mask is substantially the same as the concept of preloaded passes described herein. However, '006 discloses only the use of sweep rotation of the mask for facilitating the printing of the top edge and the bottom edge of the paper. patent '006 does not disclose the compensation for failed nozzles at the top and bottom edges of the paper, which is an object of the present invention.

Figure 5:
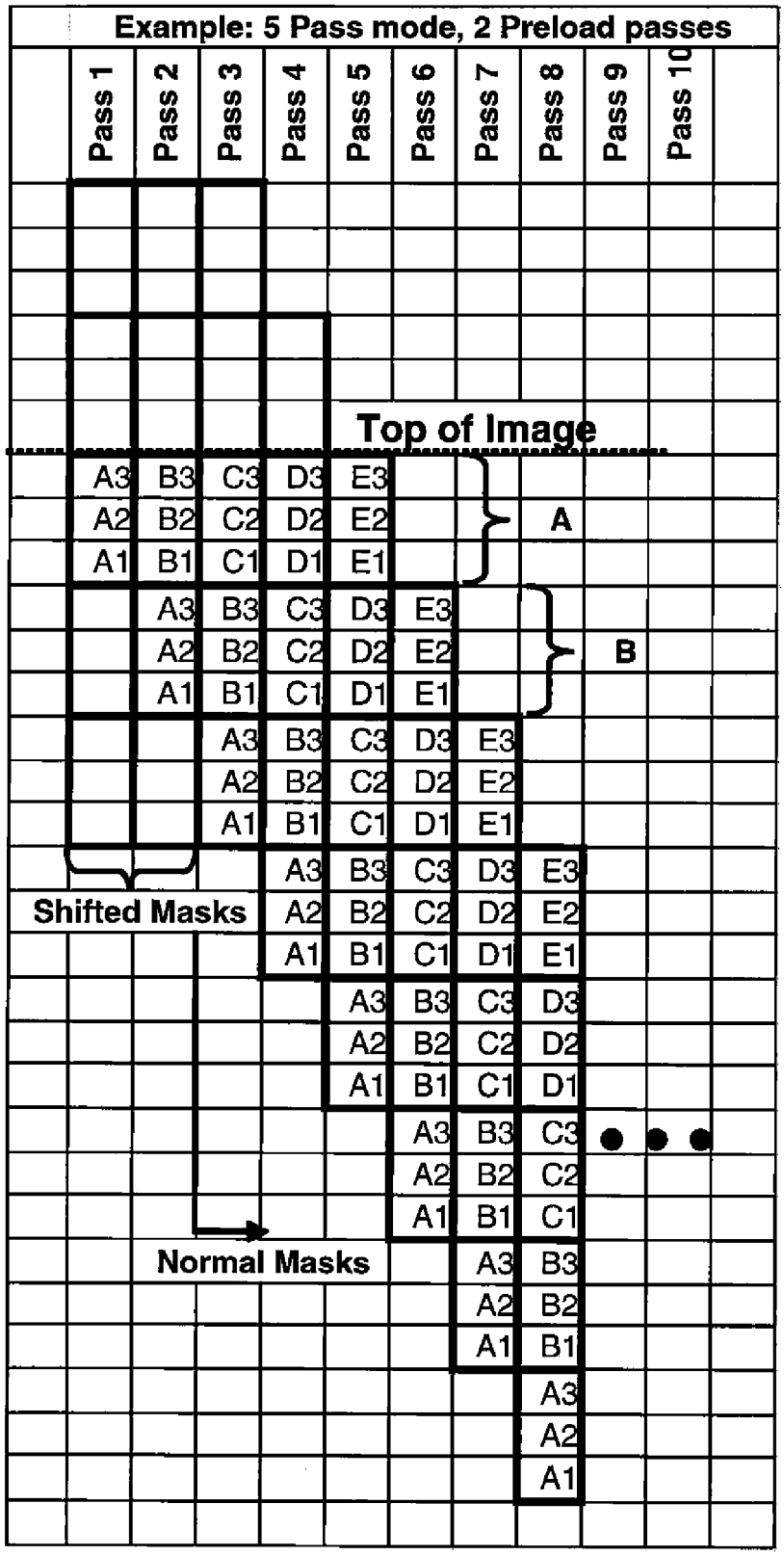
FIG. 5 illustrates an embodiment of the invention for a 5 pass mode at the leading edge of the paper.
Figure 6:
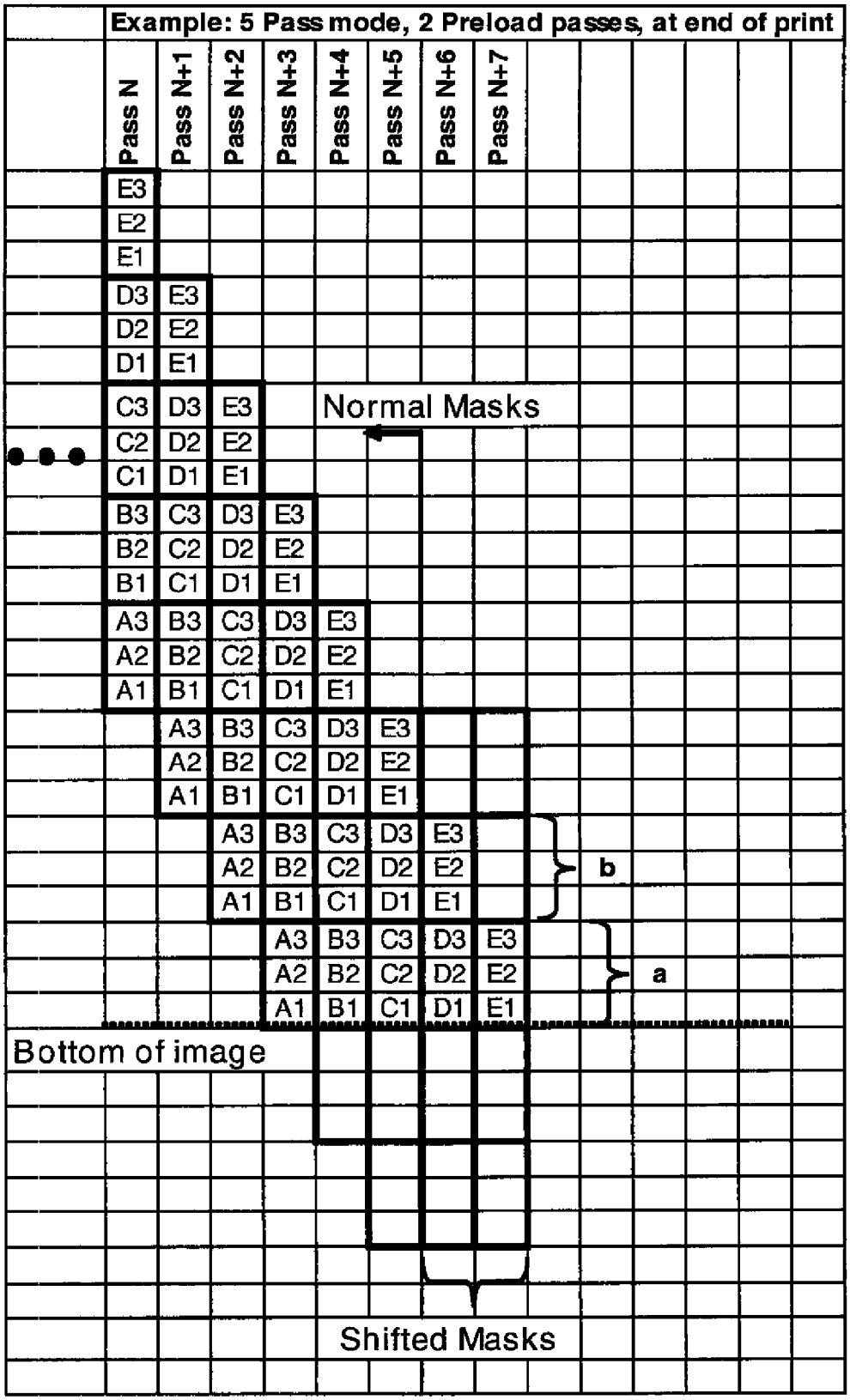
FIG. 6 illustrates an embodiment of the invention for a 5 pass mode at the trailing edge of the paper.

In a preloaded pass, the print mask and corresponding image data are shifted relative to the printhead, allowing for multipass printing when the paper is stationary. Some examples of normal print masks used with preload passes at the beginning and end of the print on the first sheet are illustrated in FIG. 5 and FIG. 6. In FIG. 5, preloaded passes 1 and 2 use shifted masks to preserve the complementary nozzle sets, thereby preserving the multipass print quality and opportunity to provide correction for failed nozzles. Note that in this arrangement, the same nozzle is used for 3 of the 5 passes in region A since the printhead has not moved between passes 1, 2, and 3, and the same nozzle is used to print data corresponding to A3, B3, and C3, for example. Similarly, 2 of the 5 passes in region B are printed by a given nozzle.

A similar technique is applied at the bottom of the printed page, as shown in FIG. 6. Similar to the top of page arrangement, the same nozzle is used for 2 of the 5 passes in region b, and 3 of the 5 passes in region a. Due to the fact that fewer nozzles are used to print in the end regions of the page, then the ability to provide for failed nozzle correction in these regions will be likewise diminished.

Figure 7:
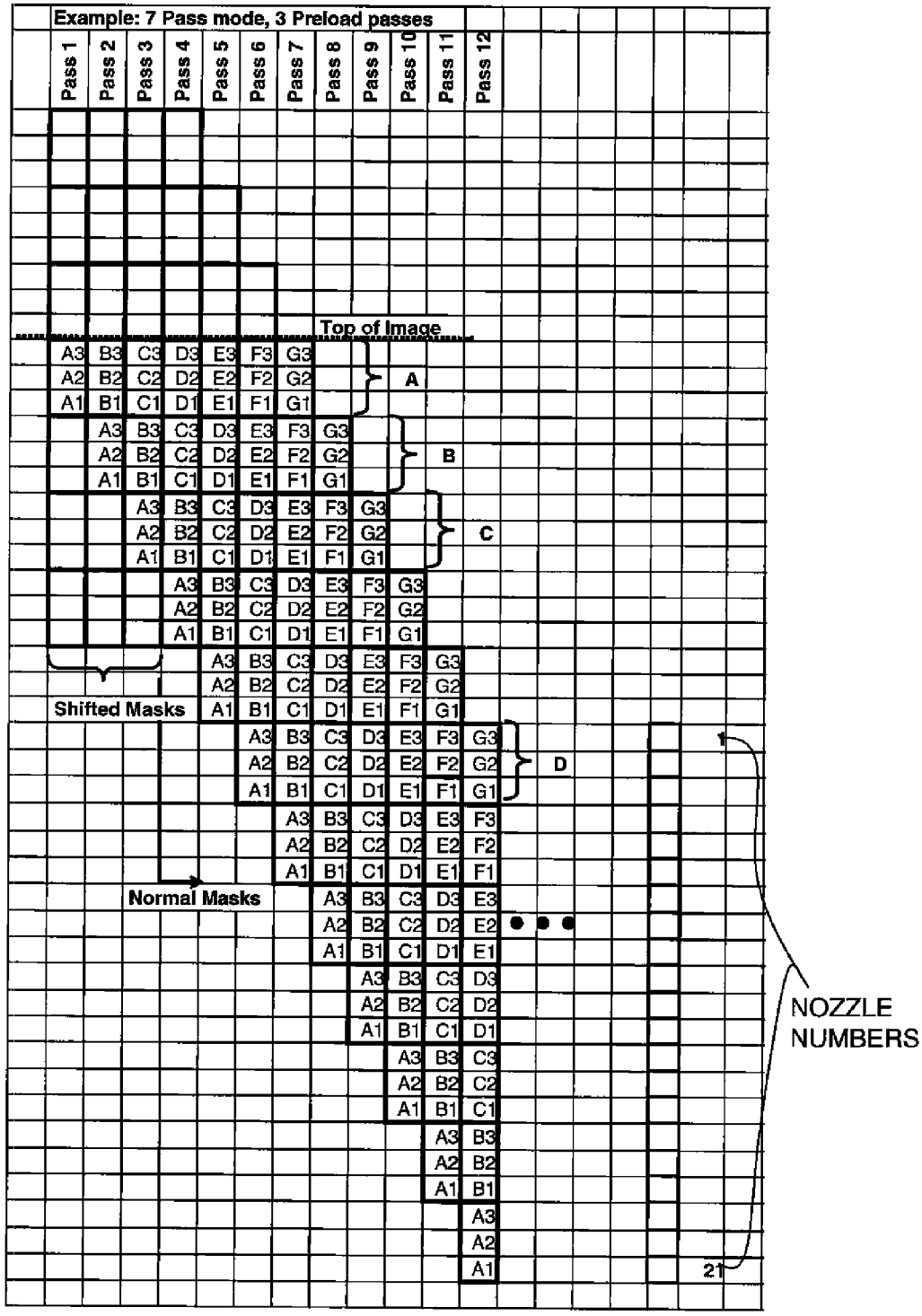
FIG. 7 illustrates an embodiment of the invention for a 7 pass mode at the leading edge of the paper.

As another example, consider a 7 pass printmode using 3 preloaded passes as shown in FIG. 7. The print mask in the example of FIG. 7 uses 21 nozzles. 7 passes with a swath height of 3, 1 mask column and has 1 mask plane, and therefore can deposit at most 1 drop per pixel. Correspondingly, the parameters for this mode are H=21, N=7, SH=3, C=1, and P=1. As described earlier, the nozzles on the printhead can be arbitrarily numbered 1 to 21 from top to bottom, where nozzle 1 corresponds to mask location G3 and nozzle 21 corresponds to mask location A1 during normal printing.

Given these parameters, let us now examine the complementary nozzle set used in region D. The image data printed in region D is printed in 7 passes where nozzles A1, A2, and A3 are used in the first pass of this region (shown as Pass 6 in FIG. 7), nozzles B1, B2, and B3 are used in the next pass (Pass 7), and so on up to nozzles G1, G2, and G3 that finish up the printing of region D on the seventh pass in this region (Pass 12). For the three raster lines in region D, the complementary nozzle sets correspond to mask locations {A1, B1, C1, D1, E1, F1, G1}, {A2, B2, C2, D2, E2, F2, G2}, and {A3, B3, C3, D3, E3, F3, G3} respectively. In region D, no preloaded passes are used, and thus mask locations {A3, B3, C3, D3, E3, F3, G3} correspond to nozzles {19, 16, 13, 10, 7, 4, 1}. This mapping of mask location to nozzle number for all of the passes in an image region is called the nozzle group list. For normal printing where no preloaded passes are used, the nozzle group list for each raster line in an image region can be computed from the nozzle group list for a known raster line in the image region. For example, if the top raster line in an image region is chosen as a reference raster line, then the nozzle group list for the next raster line in the image region can be computed by simply adding 1 to the nozzle group list for the reference raster line. Thus, in region D, the nozzle group lists for the three raster lines are {19, 16, 13, 10, 7, 4, 1}, {20, 17, 14, 11, 8, 5, 2}, and {21, 18, 15, 12, 9, 6, 3} respectively. The nozzles in a nozzle group list form a complementary nozzle set, and will print on the same raster line. Therefore, if one of the nozzles in a set fails, the other nozzles in the set can be used to compensate for the failed nozzle, and such techniques are known in the art.

However, the prior art does not teach how to perform failed nozzle correction in image regions near the edges of the page, where preloaded passes are used. in these regions, the prior art techniques will fail, because the nozzle group list for these image regions is different from the nozzle group list used in interior printing regions such as region D of FIG. 7. Not only is the nozzle group list different in the edge regions, it is dynamic and changes from region to region as the number of preloaded passes in each region changes. Thus, a simple nozzle compensation scheme such as those known in the art in which the data for a given tailed nozzle is remapped to a given working nozzle will not work, because those two nozzles may not be in the same complementary set in the preloaded passes region. The solution to this problem is the primary object of the invention, and will now be described in detail.

Returning now to the example shown in FIG. 7, let us compute the nozzle group list for region A. As before, the mask locations {A3, B3, C3, D3, F3, F3, G3} indicate which nozzles will print the top raster line of the region during the 7 passes. In region A, the same nozzle will be used to print data corresponding to A3, B3, C3, and D3 on passes 1, 2, 3, and 4, respectively. Three other complementary nozzles will be used to print data corresponding to E3, F3, and G3 on passes 5, 6, and 7, respectively. Thus, in region A there are effectively 4 complementary nozzles in each nozzle set. Similarly, the complementary nozzle sets in region B will have 5 nozzles, region C will have 6, and the "steady state" region in the interior portion of the page further down (such as region D) will have 7. The number of nozzles in a complementary nozzle set determines how many drops of ink can be printed at any location. Thus, due to the preloaded passes, the nozzle group list for the top raster line of region A will be {10, 10, 10, 10, 7, 4, 1}.

This is because the print mask is shifted in each of the preloaded passes relative to the print head, which changes the mapping between the mask location and the nozzle number. Thus, if nozzle 4 had failed and the nozzle group list for region D was used in region A, then nozzle 19 may have been selected to compensate for nozzle 4. Obviously, if this nozzle remapping was used in region A, then the compensation would not occur since nozzle 19 is not used in region A, and an image artifact would be created in the output print, degrading the quality. However, using the method of the present invention, the nozzle group list for image region A would be used to determine an appropriate nozzle to compensate for failed nozzle 4, and nozzle 1, 7, or 10 would be selected, thereby providing for correction and avoiding the image artifact.

Next, the implementation of the failed nozzle correction method according to the present invention will be discussed. In a preferred embodiment, the print mask is altered for use in the preloaded pass regions according to the nozzle group list for the region. The term "base print mask" is now introduced to define the original print mask designed for use in normal printing with a perfect printhead in which no nozzles are failed. As discussed earlier and shown in FIG. 7, the base print mask can conceptually be divided up into N mask sections, where N is the number of print passes (7 for this example). For a given image region, the nozzle group list for that region is used to assemble an intermediate region mask from the mask sections of the base print mask, as will now be described.

At this point, a further definition of the intermediate region mask is required. Consider the image region A of FIG. 7. The printhead prints image region A in 7 passes using mask sections A (A1, A2, A3) through G (G1, G2, G3) in succession. The collection of mask sections used in a given region is called the intermediate region mask. Note that the intermediate region mask contains the same number of mask sections as the base print mask, but the intermediate region mask is not a print mask. In other words, the intermediate region mask is not used in any single pass as a print mask to control the printing of ink drops by the printhead. Rather, in each print pass, the working print mask that is used is assembled from the mask sections of the intermediate region masks for each region that is printed by the printhead during the pass. Thus, the intermediate region mask is tied to the image region, and the working print mask is tied to a print pass. This distinction is critical to understanding the concept of the invention. The reason is that to provide for failed nozzle correction in the preload passes region, the intermediate region mask is altered to compensate for failed nozzles to produce a nozzle corrected intermediate region mask. Since the nozzle group lists for each region in the preloaded passes region are different, then the complementary nozzle sets will be different, and therefore the failed nozzle correction for each region will be different.

Storing the nozzle corrected intermediate region masks for each region thereby provides a means for implementing failed nozzle correction in the preloaded passes regions. For example the working print mask for pass 1 as shown in FIG. 7 has only 3 nonzero elements, as indicated by the A1, A2, and A3 mask locations that are lined up with nozzles, 12, 11, and 10, respectively. Assume now that nozzle 10 was intended to print a dot on pass 1 but the nozzle has failed, and therefore no dot will be printed. According to the nozzle group list for image region A, one of the complementary nozzles {7, 4, 1} must be used to print the missing dot on a later pass. Thus, the intermediate region mask data corresponding to one of the complementary nozzles is altered to print the dot that nozzle 10 failed to print. The selection of which complementary nozzle to use is performed by locating a complementary nozzle which does not print on a subsequent pass (meaning that the mask value for that nozzle will be 0 on that pass), and setting the mask value for that nozzle to be 1 on that pass. Similarly, the mask value for the failed nozzle is changed from 1 to 0 to effectively "turn off" the failed nozzle. A key aspect of the invention is that the mask value is changed in the intermediate region mask, so that the compensation will be performed on a later pass when the working print mask for that pass is assembled. The working print mask for a given print pass is then assembled from the nozzle-corrected intermediate region masks for the regions that are printed during the pass. This will now be described in more detail below.

For each pass, the regions that will be printed by the printhead during the pass are identified. Then, one mask section from each nozzle-corrected intermediate region mask is copied into the working print mask. For example, in FIG. 7. the working print mask for pass 1 uses mask section A from the nozzle-corrected intermediate region mask for region A (hereinafter referred to as "region mask A" for short). Mask section A from region mask A is shifted into the working mask according to the nozzle group list for region A. As discussed earlier, the nozzle group list for the top raster line of this region is {10, 10, 10, 10, 7, 4, 1} and the corresponding mask locations are {A3, B3, C3, D3, E3, F3, G3}. Since this is the first pass of the printhead over region A, then the first value in the nozzle group list is used, and mask section A from region mask A is shifted into the working mask so that nozzle 10 lines up with mask location A3. For pass 2 in region A, mask section B of region mask A is shifted into the working print mask so that nozzle 10 lines up with mask location B3, and mask section A of region mask B is shifted into the working print mask so that nozzle 7 lines up with mask element A3. In pass 3, the working print mask contains mask section A of region mask C, mask section B of region mask B, and mask section C of region mask A, shifted as indicated in FIG. 7. Thus, for each pass the working print mask is assembled from the nozzle corrected region mask sections according to the nozzle group list for each region. Additionally, mask sections that correspond to nozzles that print off the edge of the page are set to zero, and mask sections that are beyond the extremes of the shifted nozzle corrected region mask (such as those below the A1 mask location in pass 1) are also set to zero.

It is possible to precompute and store the working print masks in temporary or permanent memory for the print passes, since the nozzle group lists and failed nozzles can be determined a priori. Precomputing and storing the working print masks provides for a processing speed improvement, since the masks will not have to be assembled on the fly as the page is being rendered or printed. The precomputed masks will require additional memory storage, and one skilled in the alt will be able to make the appropriate tradeoff of memory vs. processing efficiency for their given system. Other possibilities include precomputing and storing the intermediate region masks, and then assembling the working print mask on the fly, or of course, computing the entire working print mask from the base print mask on the fly, as the processing speed of the printer permits.

The invention has been described in detail with particular reference to certain preferred embodiments thereof as shown in FIG. 7, but it will be understood that variations and modifications can be effected within the spirit and scope of the invention.

Figure 8A:
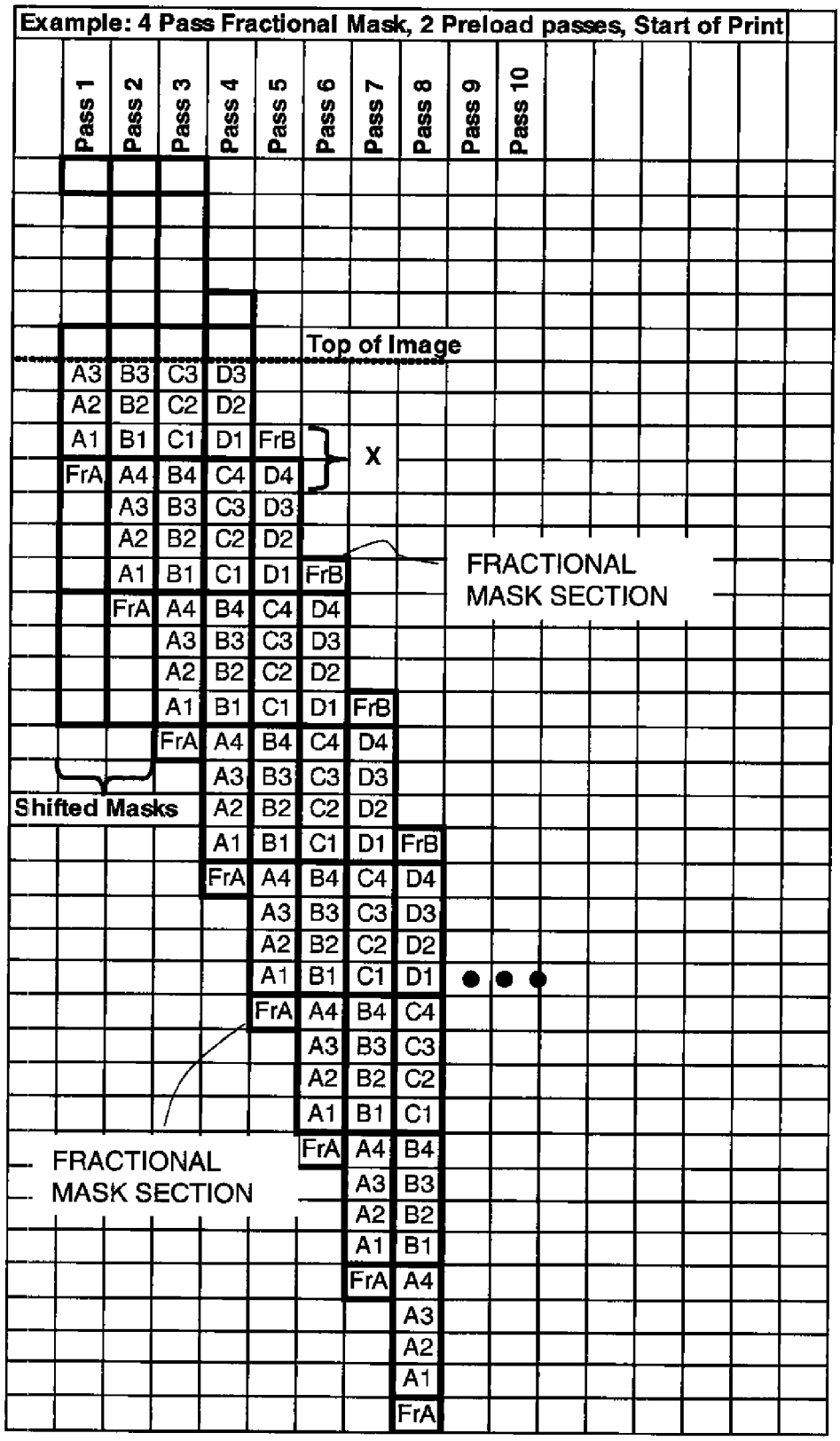
FIG. 8A illustrates an embodiment of the invention for a 4/5 pass fractional mask at the leading edge of the paper.
Figure 8B:
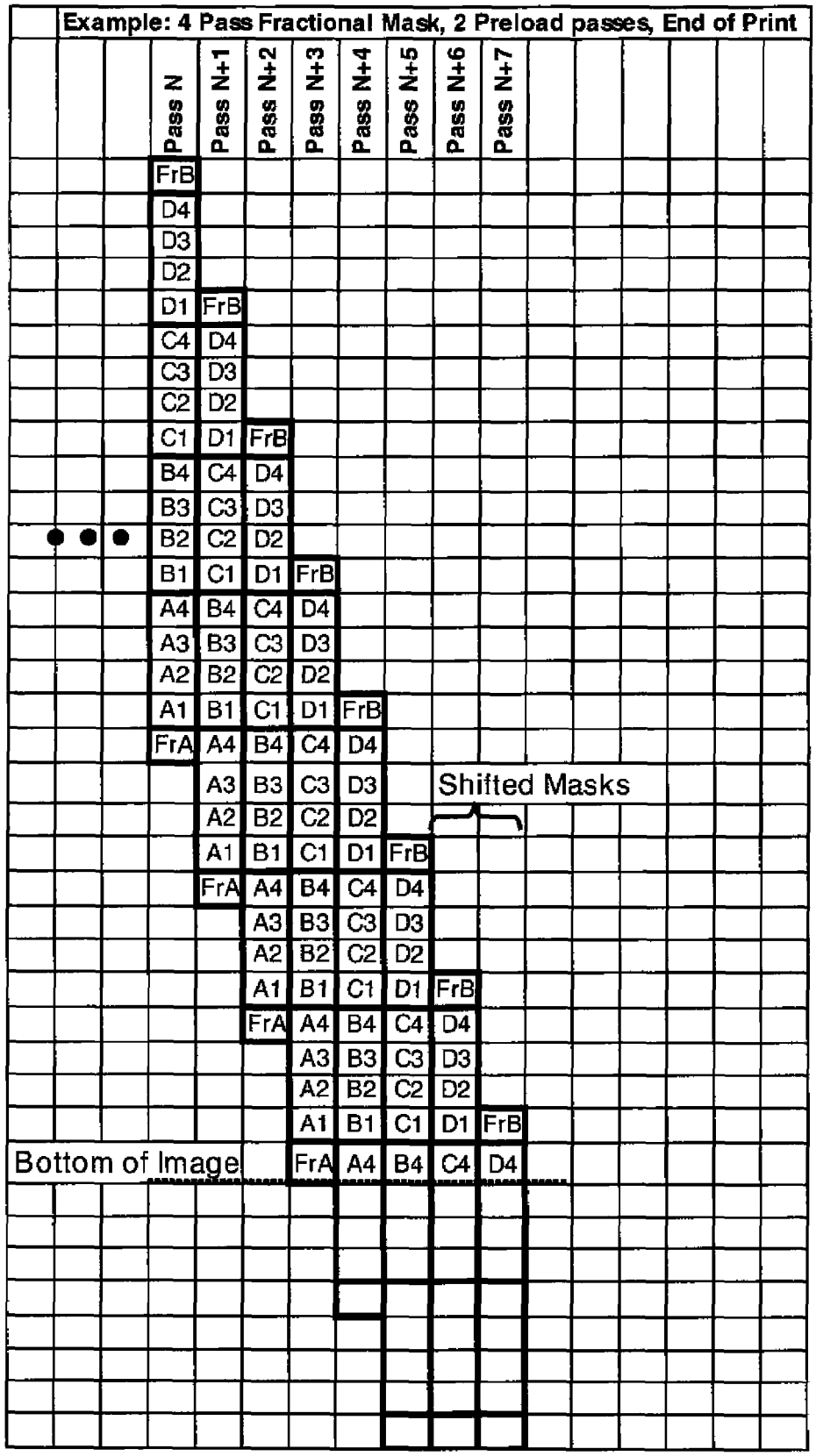
FIG. 8B illustrates an embodiment of the invention for a 4/5 pass fractional mask at the trailing edge of the paper.

For example, the method of the present invention is also applicable to print masking techniques that employ "fractional" print masks, in which the page advance distance is not equal to the number of nozzles divided by the number of passes. U.S. Pat. Nos. 6,310,640 and 6,375,307 describe fractional print modes. Such a system is shown in FIGS. 8A and 8B for a 4 pass/5 pass print mode. Areas where fractional mask sections (such as FrA and FrB) land are printed using 5 passes rather than 4 passes. See region X, for example, in FIG. 8A. Typically, in fractional print masking, the page is underadvanced by a small amount, resulting in more nozzles being used to print the raster lines near the swath boundaries. This technique is known in the art to provide for improved print quality near the swath boundary regions. The present invention would apply equally well to such a system, and the nozzle group list for some raster lines would simply have more entries than for other raster lines. The aspects of creating the nozzle corrected intermediate region mask for each region and assembling the working print mask for the pass as described above would directly translate to the fractional print masking case. In FIG. 8B, note that the bottom of the image may fall anywhere in the mask range, so the pass to start the trail edge preload passes must be calculated based on the image size. If the bottom of the image in the example of FIG. 8B was a little higher, the preload passes would have started one pass sooner.

The method of the present invention would also apply equally well to a multilevel print mask having more than one mask plane, as discussed earlier. In this case, the nozzle corrected intermediate region mask would have a number of planes corresponding to the base print mask, and the failed nozzle correction would be performed on each mask plane. The assembly of the working print mask from the nozzle corrected intermediate region mask would then be performed as described above.

One skilled in the art will recognize that in the preloaded passes region, since fewer unique nozzles are used in the nozzle group lists (due to the fact that the same nozzle is used on several passes because the printhead is not advanced), then the ability to correct for failed nozzles is somewhat diminished. Similarly, in the multilevel printing case, where more than one ink drop may be desired to be printed at a given pixel, the failed nozzle correction method according to the present invention may not be capable of completely correcting for all of the missing ink drops. However, the present invention provides for compensating for the missing drops to the extent that is physically possible given the number of print passes used. Also, in some cases, the complementary nozzle selected to use for a failed nozzle is also failed. In these cases, a third complementary nozzle may need to be selected to perform the duty of two failed nozzles. As one skilled in the art will realize, the ability to compensate for failed nozzles in this situation will be likewise diminished, but the present invention provides for a method to achieve the failed nozzle correction up to the limits of what is physically possible.

The invention claimed is:

1. A method for compensating for failed nozzles in multi-pass printing using an inkjet printer having at least one printhead containing a plurality of nozzles to print an input image having a plurality of raster lines on a receiver media, wherein the image is printed using a plurality of passes, and wherein the receiver media advance distance between passes is different at the leading and/or trailing edges of the page than the middle of the page, the method comprising the steps of:

a. determining a plurality of image regions comprising two or more different regions wherein one region is at the leading or trailing edge and one region is in the middle of the page wherein the receiver media advance distance between passes is different at the leading or trailing edge regions of the page than the middle region of the page, each image region corresponding to at least one raster line of the input image;

b. computing a different nozzle group list for each image region of said two or more image regions, wherein each nozzle group list describes a set of nozzles used to print each raster line of the image region during each pass; and c. using the nozzle group list to remap the printing of ink drops from the failed nozzle to at least one other nozzle.

2. The method of claim 1 wherein the receiver media is not advanced between at least two passes.

3. The method of claim 1 wherein the nozzle group list for each region contains a mapping between the nozzle number and the pass number for a reference raster line of the region.

4. The method of claim 3 wherein the mapping for each raster line of the region is computed from the mapping for the reference raster line in the region.

5. The method of claim 3 wherein the reference raster line is the top raster line in the region.

6. The method of claim 1 wherein step c) further includes using a print mask to determine the ink drops that are printed by a given nozzle in a given pass.

7. The method of claim 6 wherein remapping the ink drops from the failed nozzle to at least one other nozzle includes altering the print mask used by the failed nozzle and the at least one other nozzle.

8. The method of claim 7 wherein altering the print mask includes the steps of;

a. specifying a base print mask;

b. computing an intermediate region mask for each image region by copying the base print mask and modifying the mask values for the failed nozzle and at least one complementary nozzle to remap the printing of ink drops from the failed nozzle to at least one complementary nozzle; and c. assembling the print mask for a given pass from the intermediate region masks for each of the image regions printed by the printhead during the given pass.

9. The method of claim 8 wherein the print mask is a fractional print mask.

10. The method of claim 8 wherein modifying the mask values for the failed nozzle includes setting the mask values to zero for that nozzle.

11. The method of claim 8 wherein the print mask is subdivided into a plurality of mask sections, wherein the height of each mask section is determined from the number of nozzles and the number of passes.

12. The method of claim 8 wherein step c) further includes:

a. copying the mask sections from the intermediate region masks for each of the image regions printed by the printhead during the given pass to form a set of mask sections;

b. shifting and placing the data from each mask section of the set of mask sections into the print mask for the given pass according to the value in the corresponding nozzle group list.

13. The method of claim 8 wherein the print mask values are set to zero for nozzles that correspond to raster lines beyond the edge of the image.

14. The method of claim 8, further comprising precomputing and storing the print masks needed for a print in temporary or permanent memory to speed up printing.

15. The method of claim 6 wherein the print mask is suitable for multi-level printing wherein more than one inkdrop is printed at one time.

16. The method of claim 1 wherein the at least one other nozzle used in step c) is a complementary nozzle to the failed nozzle.

* * * * *